United States Patent [19]

Wentzler

[11] 4,217,208

[45] Aug. 12, 1980

[54] METHOD FOR SEPARATING SOLID LUBRICATING MATERIAL FROM DRILL CUTTINGS

[75] Inventor: Thomas H. Wentzler, Midland, Mich.

[73] Assignee: The Dow Chemical Company, Midland, Mich.

[21] Appl. No.: 51,918

[22] Filed: Jun. 25, 1979

Related U.S. Application Data

[63] Continuation of Ser. No. 906,892, May 18, 1978, abandoned.

[51] Int. Cl.[2] ..... B03B 5/04

[52] U.S. Cl. ..... 209/18; 175/206; 209/441

[58] Field of Search ..... 209/2, 13, 17, 18, 44, 209/155, 157, 313, 315, 441, 488, 497; 175/66, 206; 210/384, 388, 389

[56] References Cited

U.S. PATENT DOCUMENTS

| | | | |
|---|---|---|---|
| 2,242,562 | 5/1941 | Weber | 209/441 |
| 2,576,283 | 11/1951 | Chaney | 175/66 X |
| 2,582,302 | 1/1952 | Weber | 209/441 |
| 2,943,679 | 7/1960 | Scott et al. | 166/21 |
| 3,216,933 | 11/1965 | Park et al. | 252/8.5 |
| 3,291,306 | 12/1966 | Stone | 209/441 |
| 3,879,284 | 4/1975 | Davies | 209/441 |
| 4,063,603 | 12/1977 | Rayborn | 175/65 |

*Primary Examiner*—William A. Cuchlinski, Jr.

[57] ABSTRACT

Solid lubricating particles such as spherical plastic beads which are useful in drilling operations are separated from drill cuttings by (1) depositing a mixture of the particles and cuttings on a reciprocating deck which operates in a manner such that the mixture moves in one direction across the deck and (2) passing a wash stream across the mixture in a second direction approximately perpendicular to the direction of the mixture flow. The wash stream causes the solid lubricating particles to move in the second direction at a rate significantly greater than the drill cuttings. The lubricating particles are readily recovered from the drill cuttings for reuse in the drilling operation.

8 Claims, 2 Drawing Figures

METHOD FOR SEPARATING SOLID LUBRICATING MATERIAL FROM DRILL CUTTINGS

This is a continuation of application Ser. No. 906,892 filed May 18, 1978 now abandoned.

BACKGROUND OF THE INVENTION

This invention relates to methods for separating solid lubricating materials used in drilling operations from the cuttings generated by such drilling operations.

In drilling operations, a drilling mud is often employed to remove the chips or cuttings produced by the rotating drill bit and to reduce friction or provide a lubricating medium for the drill bit and drill pipe. In operation, the drilling mud is pumped down the drill pipe, through the drill bit where it picks up the cuttings and is returned to the surface between the drill pipe and the wall of the well bore. The drilling mud containing the cuttings is then conventionally fed through a shale shaker which removes the larger size cuttings, e.g, particles larger than about 50 mesh. The recovered mud, i.e., that mud which passes through the shale shaker, is reused in the drilling operation. By-passing the shale shaker is undesirable in that the drill cuttings are recirculated down the well where they are reground by the bit and dispersed in the drilling mud. This results in an undesirable viscosity increase in the drilling mud, requiring frequent dilution and reweighting of the mud with other additives.

In many drilling operations, particularly directional drilling operations, the drill pipe contacts the wall of the well bore. The drag created by such contact increases the torque required to rotate the drill pipe at a fixed rate. As these points of contact increase, the torque required to drive the drill pipe increases to a maximum level above which further increases in torque would probably break the drill pipe. Thus, the rate at which the drill pipe is rotated must be reduced to maintain the torque at or below this maximum. Unfortunately, this rotation rate reduction generally creates a less efficient drilling operation.

To reduce this drag, a hard, particulate material is often added to the drilling mud as a lubricating material. This particulate material provides a rolling support for the drill pipe at its points of contact with the walls of the well bore, thereby reducing the torque required for effective drilling.

Particulate materials which have been found to be particularly useful as solid lubricating materials are known to possess a size in the range from 10 to 100 mesh and a relatively uniform shape, preferably spherical. See, for example, U.S. Pat. No. 2,943,679 to Scott and Fischer and U.S. Pat. No. 4,063,603 to Rayborn.

Unfortunately, many of the solid lubricating particles, e.g., the particles of greater than 50 mesh size, are removed from the drilling mud during the recovery of the drilling mud in the shale shaker operation. Heretofore, the solid lubricating particles thus removed could not be readily recovered for reuse.

In view of these deficiencies, it is highly desirable to provide a method of separating the solid lubricating particles from the drill cuttings which have not passed through the shale shaker with the drilling mud.

SUMMARY OF THE INVENTION

Accordingly, the present invention is such a method of separating the solid lubricating particles from drill cuttings comprising the steps of (1) depositing a feed mixture containing the solid lubricating particles and drill cuttings on a reciprocating deck which operates in a manner such that the feed mixture flows in one direction across the deck and (2) passing a wash stream across the feed mixture in a second direction approximately perpendicular to the direction of the mixture flow thereby causing the solid lubricating particles to move in the second direction at a rate greater than the drill cuttings.

Surprisingly, it is found that the solid lubricating particles are effectively separated from the drill cuttings by this method. The separated lubricating particles are essentially devoid of drill cuttings and are recovered at relatively high percentages, e.g., 95 to 99 percent by weight of the lubricating particles in the feed mixture are recovered.

The recovered lubricating particles are effectively recycled in the drilling mud, thereby reducing the cost and materials required for maintaining an efficient drilling operation.

BRIEF DESCRIPTION OF THE DRAWINGS

Understanding of this invention will be facilitated by referring to the accompanying drawings, in which.

DETAILED DESCRIPTION OF THE PREFERRED EMBODIMENT

Figure 1:
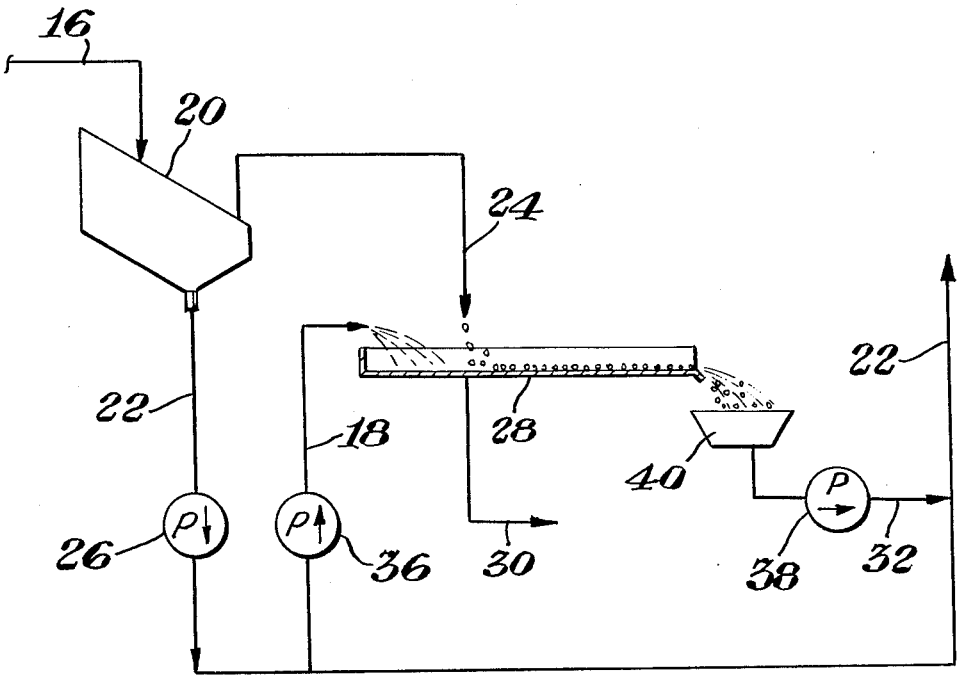
FIG. 1 is a diagrammatic flow sheet of a recovery process in a drilling operation incorporating a method of separation described by this invention.

Referring now more particularly to the drawings, FIG. 1, which represents an embodiment of this invention, depicts a return line 16 from the drill pipe (not shown) which discharges a mixture of drilling mud, drill cuttings and solid lubricating particles onto shale shaker 20. Shale shaker 20 is a vibrating screen or screens having screen openings generally ranging from about 40 to about 80 mesh (Tyler standard screen size), depending on the particular drilling operation. The material retained on the screens of the shale shaker 20 comprises oversized drill cuttings and solid lubricating particles, e.g., 20 to 50 mesh particle size, and small amounts, e.g., about 1 to 10 weight percent of retained drilling mud and/or its various components. This material is fed through line 24 to separating device 28.

The drilling mud which passes through shale shaker 20 is pumped through line 22 by pump 26. A portion of the drilling mud in line 22 is removed by pump 36 and fed through line 18 to separating device 28. The separated solid lubricating particles and wash stream are recovered in receptacle 40. This recovered material is pumped through line 32 by pump 38 to line 22. The separated drill cuttings are discarded through waste line 30.

Figure 2:
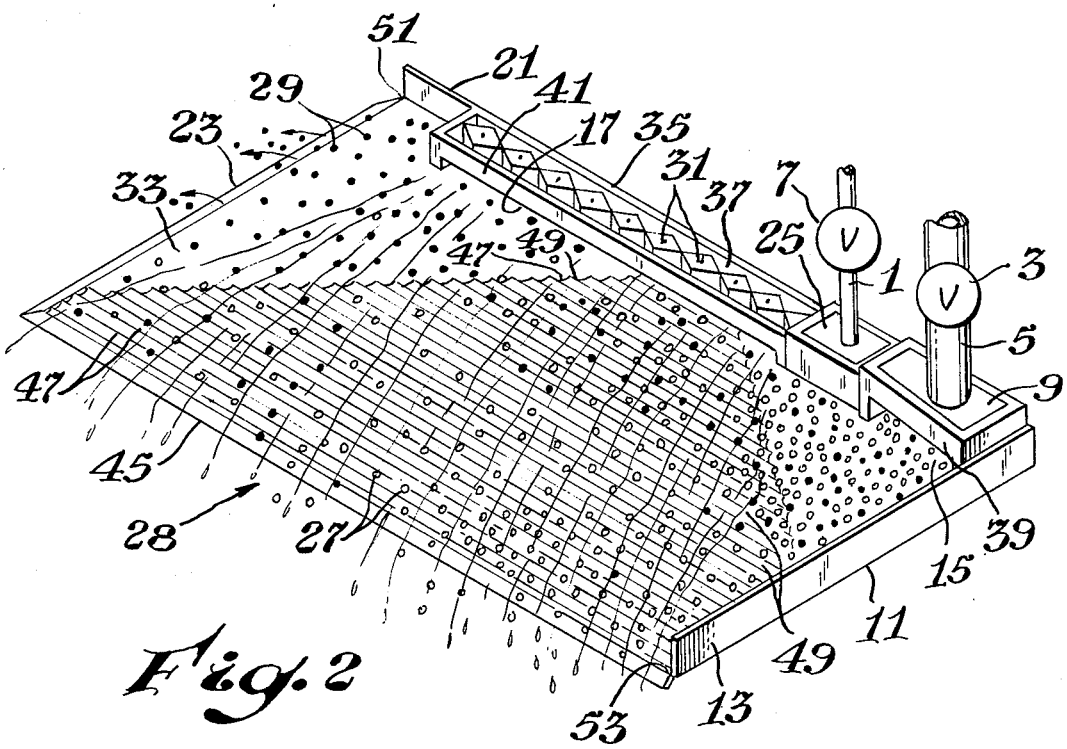
FIG. 2 is a schematic isometric view illustrating a separating device useful in the practice of this invention.

FIG. 2 depicts a separating device 28 which is advantageously employed in practicing the method of this invention. Separating device 28 comprises a deck 33 having a plurality of riffles 47 thereon which extend generally parallel to each other and lie primarily in a direction from feed end 11 to waste discharge side 23. Deck 33 is partially enclosed at feed end 11 by headboard 13 extending to corner 53 of deck 33 and on feed side 35 by headboard 21 extending to corner 51 of deck 33. Along waste discharge end 23 and wash discharge side 45, deck 33 is beveled downwardly to facilitate collection of materials exiting therefrom.

Positioned on deck 33 inside the juncture of headboards 21 and 13 and proximate thereto is feed box 9. A conduit 5, having one end connecting into feed box 9, provides communication between feed box 9 and the source of the feed mixture (not shown). A valve 3 is installed in conduit 5. Located at the bottom of wall 39 of feed box 9 is opening 15 which provides communication between feed box 9 and deck 33.

Proximate to feed box 9 and juxtapositioned to headboard 21 is located service entry 25 which is intimately connected to launder 37. A conduit 1, having one end connecting into the service entry 25, provides communication between the service entry 25 and the source of the wash stream (not shown). A valve 7 is installed in conduit 1. A plurality of diamond shaped blocks 31, each being pivotally mounted, are in longitudinal series along the discharge edge of launder 37. Along the bottom of wall 41 of launder 37 is opening 17 which provides communication between launder 37 and the deck 33.

In operation, a feed mixture of solid lubricating particles 27, drill cuttings 29 and retained drilling mud is fed through conduit 5 to feed box 9. Flow of said feed mixture is controlled by valve 3. The feed mixture is forced through opening 15 onto deck 33. A drive means (not shown) moves deck 33 in a reciprocating motion such that the lubricating particles 27 (light particles) and drill cuttings 29 (dark particles) move primarily in a direction away from feed end 11 to waste discharge end 23.

A wash stream is fed through conduit 1 to service entry 25 and from there to launder 37. From launder 37 the wash stream flows through opening 17 onto the deck 33 across the feed mixture in a second direction primarily from feed side 35 to wash discharge side 45. Thus, the wash stream flows in a direction approximately perpendicular to the direction of the feed mixture flow.

Valve 7 of conduit 1 and blocks 31 of launder 37 control the flow and distribution of said wash stream such that the combination of the movement of deck 33 and the wash stream moves the lubricating particles primarily toward wash discharge side 45 and the drill cuttings 29 primarily toward waste discharge end 23. Moreover, the drill cuttings 29 tend to settle in spaces 49 between riffles 47 which further assists the movement of drill cuttings 29 in a direction towards discharge end 23. The majority of the solid lubricating particles do not settle in space 49. To further facilitate separation, the deck 33 may be advantageously tilted at an angle from horizontal. Advantageously, such tilt is along a line from corner 51 to corner 53 at an angle from about 0° to 5° from horizontal, with corner 53 being closest to the ground. FIG. 2 depicts schematically an approximate distribution of the solid particulate material 27 and drill cuttings 29 on the deck 33 during operation.

The separated solid lubricating particles are easily collected from wash discharge side 45 by conventional techniques, e.g., a receptacle. It is often desirable to adjust the receptacles to collect only that material exiting from the deck 33 nearest corner 53 to obtain lubricating particles 27 which are essentially free of drill cuttings 29. Such adjustment is easily made during the first few minutes of operation. The remainder of material exiting from discharge side 45 and all material exiting from waste discharge end 23, may be sent to waste or can be further separated by passing the material over a second deck.

With regards to the various components of the separating devices of this invention, the reciprocating deck of the separating device depicted in FIG. 2 can be of various shapes, sizes and made from a variety of materials. Examples of such materials is steel or other suitable metal having a rubber cover and cemented-on rubber riffle or a high-grade linoleum cover having wood riffles. A smooth rubber or linoleum cover, i.e., one not having riffles, is also suitably employed.

Movement in the decks of separating devices suitably employed in this invention is a reciprocating movement, advantageously induced by any suitable head motion device which moves the deck slowly in the direction of the waste discharge end and rapidly in the direction of the feed end, i.e., in a direction generally parallel with the riffles. The rate and distance of such movement is dependent on various factors; including the composition, specific gravity and size of the drill cuttings and solid lubricating particles, and the surface configuration and construction of the deck. As an example, a rate of between about 100 and about 300 strokes per minute for a distance from about 0.5 to about 1.5 inches is advantageously employed using a separating device as depicted in FIG. 2 when separating spherical beads of a styrene/divinylbenzene copolymer from the drill cuttings.

Other variations in design, dimensions, structure and components of separating devices useful in the practice of this invention will readily occur to those skilled in the art. For purposes of illustration and not limitation, reference is made to U.S. Pat. Nos. 2,582,302; 2,242,562 and 3,291,306.

For the purposes of this invention, the feed mixture comprises solid lubricating particles, drill cuttings, and a minor amount, e.g., from about 1 to about 10 percent of the drilling mud. Typically, such feed mixture is that material which has been rejected by the shale shaker in the recovery process of the drilling operation.

By the term "solid lubricating particles" it is meant those particles which can be employed as a lubricating material in drilling muds. Representative examples of such materials include plastic beads, aluminum shot, and other like materials such as those disclosed in U.S. Pat. Nos. 2,943,679; 3,216,933 and 4,063,603. Typically, materials described therein have sizes ranging from about 10 to about 100 mesh (Tyler standard screen size) and a specific gravity between about 0.8 to about 2.5. The methods of this invention are suitably employed with all such materials provided with specific gravity of said particles are less than the specific gravity of the drill cuttings. Preferably, the specific gravity of the solid lubricating particles is less than about 85 percent, more preferably less than about 70 percent, of the specific gravity of the drill cuttings. Of such materials, the methods of this invention are particularly advantageous for separating spherical plastic bead materials having a specific gravity from about 0.9 to about 1.5 (grams per cubic centimeter at 20° C.), especially spherical beads of styrene/divinylbenzene copolymers as described by U.S. Pat. No. 4,063,603.

The terms "drilling mud" and "drill cuttings" are well defined in the art and are used conventionally herein.

The wash stream in this invention may be any normally flowable material which does not dissolve or otherwise significantly effect the drill cuttings and solid particulate material. Minor surface interactions such as hydrolysis of the drill cuttings or particulate material are not presumed to have a significant effect. Although many conventional liquids, slurries or solutions are usable, the wash stream is preferably water or the drilling mud which has passed through the shale shaker. When water is employed as the wash stream, the lubricating material is advantageously dewatered prior to reuse. No dewatering is necessary prior to reuse when the recycled drilling mud is the wash stream.

In the practice of this invention; advantageously, the flow rate of the wash stream employed is that minimum flow rate necessary to effect separation of the lubricating particles from the drill cuttings. Such flow rate most advantageously employed is dependent on a variety of factors including the separating device employed, the motion in the surface thereof, the composition of the feed mixture and the distribution of the wash stream exiting from the launder. Typically, flow rates between about 1.5 and about 40 gallons per minute are suitably employed. The flow rates within this range which provide maximum separation are easily determined during the first few minutes of operation.

The following examples are presented to illustrate this invention and should not be construed to limit its scope. All parts and percentages are by weight unless otherwise specified.

EXAMPLE 1

A 2993 g. sample of styrene/divinylbenzene copolymer beads having a density of about 1.05 g./cm$^3$ useful as a solid lubricating material in drilling muds and having the following size distribution:

| Mesh Size | Percent |
|---|---|
| −18 +25 | 2.5 |
| −25 +35 | 8.8 |
| −35 +45 | 7.6 |
| −45 +60 | 49.5 |
| −60 +80 | 27.9 |
| −80 | 3.7 |

is mixed with a 1052 g. sample of drill cuttings having the following size distribution:

| Mesh Size | Percent |
|---|---|
| +10 | 29.2 |
| −10 +18 | 12.7 |
| −18 +25 | 14.5 |
| −25 +35 | 12.5 |
| −35 +45 | 12.0 |
| −45 +60 | 9.0 |
| −60 +80 | 10.1 |

to form a feed mixture. The feed mixture is deposited in a storage container connected to a Super-Duty Diagonal Deck 15-S Table separator sold by The Deister Concentrator Company, Inc., which is similar to the separating device shown in FIG. 2.

A reciprocating motion is begun in the separator's deck by a drive means intimately connected thereto. Said motion consists of a slow movement towards the waste discharge stream and a rapid movement in the direction of the feed end at about 200 strokes per minute, each stroke traversing about 0.75 inch. During such motion, the feed mixture as defined above, is added to the feed box at a rate of 450 g/minute. Simultaneously, a water wash stream is passed across the separator's surface in a direction at about 90° to the shaker motion at a rate of about 1500 g/minute.

The separator is equipped with three collection devices. A wash collection device is positioned along the wash discharge side such that it will collect all material exiting from the separator's deck along the ⅔ of this side nearest the juncture of this side with the feed end.

A second collection device, i.e., middlings collection device, is positioned along the remainder of the wash discharge side. A cuttings collection device is positioned at the waste discharge end in a manner suitable to collect all material leaving the separator's deck at that end.

The wash stream is continued during the complete addition to the feed mixture and for an additional period of time sufficient to remove all the drill cuttings and lubricating particles from the separator's deck.

The material collected in the three collection devices is then dried and weighed. The wash collection device is found to yield 2870 g. of essentially pure, i.e., essentially free of drill cuttings, styrene/divinylbenzene copolymer beads. This represents almost 96 percent of the copolymer beads in the feed stream. The middlings collection device is found to yield 124 g. of a mixture of the copolymer beads and drill cuttings, the beads comprising about 80 volume percent of said mixture. The waste collection device is found to contain 1050 g. of essentially pure drill cuttings.

As evidenced by this data, the method of this invention for separating lubricating particles from drill cuttings permits the recovery of the lubricating particles at high yields.

EXAMPLE 2

A feed mixture is prepared by mixing a 6376 g. sample of a drilling mud with a 741 g. sample of styrene/divinylbenzene copolymer beads similar to the copolymer beads employed in Example 1. The drilling mud is useful in a drilling operation in Louisiana and is that material which does not pass through the shale shaker at the drilling state. It comprises about 12.7 percent drill cuttings (about 806 g.) with the remainder being water, gumbo clay and fine particles, i.e., smaller than 100 mesh, of bentonite and barite.

The drill cuttings and copolymer bends in the feed mixture are separated using the method of Example 1 except that the separator is equipped with only two collection devices. A wash collection device is positioned along the wash discharge side such that it collects all the material leaving the separator's surface at that side and a cuttings collection device is positioned along the waste discharge end such that it collects all material leaving the separator's surface at that end.

After separation, the material in the cuttings collection device is dried and found to contain 790 g. of drill cuttings which represents about 98 percent of the drill cuttings in the feed mixture.

The material in the wash collection device is analyzed by dense media separation techniques using sodium chloride solutions of varying specific gravities to determine the concentration of the drill cuttings and copolymer beads at sizes greater than 100 mesh. The results of this testing are shown in Table I.

TABLE I

| Mesh Size | Copolymer Beads (g.) | Drill Cuttings (g.) | Percent Copolymer Beads |
|---|---|---|---|
| +20 | 268.5 | 3.5 | 98.7 |
| −20 +50 | 456.7 | 3.3 | 99.3 |
| −50 +80 | 8.8 | 2.6 | 77.2 |
| −80 +100 | 0.4 | 4.9 | 7.6 |

As evidenced by the foregoing Table, a 734.4 g.-portion of the copolymer beads which represents 99.1 percent of the copolymer beads in the feed stream is recovered in the wash collection device, whereas only a 15.3 g.-portion of the drill cuttings or about 1.9 percent of the drill cuttings in the feed stream is present in the wash collection device. As particles smaller than from about 80 to about 100 mesh do not normally affect the drilling operations, the method of this invention is shown to effectively separate the copolymer beads from the drill cuttings.

What is claimed is:

1. A method for separating solid lubricating particles from a mixture of solid lubricating particles and drill cuttings, wherein the lubricating particles have a specific gravity less than the specific gravity of the drill cuttings comprising the steps of:

(1) depositing a feed mixture containing the solid lubricating particles and drill cuttings on a reciprocating deck which operates in a manner such that the feed mixture flows in one direction across the deck; and (2) passing a wash stream of a drilling mud across the feed mixture in a second direction approximately perpendicular to the direction of the feed mixture flow thereby causing the solid lubricating particles to move in the second direction at a rate greater than the drill cuttings.

2. The method of claim 1 wherein the separated solid lubricating particles are collected.

3. The method of claim 1 wherein the deck comprises a plurality of riffles which extend generally parallel to each other and primarily in the direction of the feed mixture flow.

4. The method of claim 1 wherein the solid lubricating particles are spherical plastic beads having a specific gravity from about 0.9 to 1.5.

5. The method of claim 4 wherein the solid lubricating particles comprise a copolymer of styrene and divinylbenzene.

6. The method of claim 1 wherein the solid lubricating particles are a hard, particulate material having a specific gravity less than about 85 percent of the specific gravity of the drill cuttings.

7. The method of claim 1 wherein the separated spherical beads are reused in the drilling operation without prior dewatering.

8. The method of claim 7 wherein the wash stream is the drilling mud which passes through the shale shaker in the recovery process of the drilling operation.

* * * * *

UNITED STATES PATENT AND TRADEMARK OFFICE

CERTIFICATE OF CORRECTION

PATENT NO. : 4,217,208

DATED : August 12, 1980

INVENTOR(S) : Thomas H. Wentzler

It is certified that error appears in the above—identified patent and that said Letters Patent is hereby corrected as shown below:

Column 4, line 54, delete "with", insert --the--
Column 6, line 18, delete "to", insert --of--
Column 6, line 45, delete "state", insert --site--
Column 6, line 49, delete "bends", insert --beads--

Signed and Sealed this

*Seventeenth* Day of *March 1981*

[SEAL]

*Attest:*

RENE D. TEGTMEYER

*Attesting Officer*

*Acting Commissioner of Patents and Trademarks*